United States Patent [19]

Goodman

[11] Patent Number: 4,597,319

[45] Date of Patent: Jul. 1, 1986

[54] FLUID ACTUATOR SLEW RATE CONTROL

[75] Inventor: Robert B. Goodman, W. Hartford, Conn.

[73] Assignee: United Technologies Corporation, Hartford, Conn.

[21] Appl. No.: 562,128

[22] Filed: Dec. 16, 1983

[51] Int. Cl.[4] ..... F15B 15/22

[52] U.S. Cl. ..... 91/27; 91/31; 91/407

[58] Field of Search ..... 91/6, 20, 27, 31, 410, 91/25, 394, 422, 407; 137/513.3

[56] References Cited

U.S. PATENT DOCUMENTS

| | | | |
|---|---|---|---|
| 1,136,899 | 4/1915 | Greer | 91/27 |
| 1,942,543 | 1/1934 | Forman . | |
| 2,115,845 | 5/1938 | Forman | 91/407 |
| 2,512,205 | 6/1950 | Hall . | |
| 2,584,995 | 2/1952 | Fageol | 91/410 |
| 3,004,390 | 10/1961 | Duffy | 60/97 |
| 3,167,920 | 2/1965 | Fleury | 60/54.5 |
| 3,364,821 | 1/1968 | Gephart et al. | 137/513.3 |
| 3,613,724 | 10/1971 | Carson | 91/410 |
| 3,814,553 | 6/1974 | Hubschmann | 417/511 |
| 3,877,344 | 4/1975 | Langland | 91/407 |
| 4,050,357 | 9/1977 | Carter, Sr. et al. | 91/410 |
| 4,138,928 | 2/1979 | Pilch | 91/27 |

*Primary Examiner*—Abraham Hershkovitz
*Attorney, Agent, or Firm*—John Swiatocha

[57] ABSTRACT

Initiation of piston movement in a fluid actuator and sustained piston movement at a controlled rate are achieved by control of servo pressure in the actuator.

5 Claims, 5 Drawing Figures

FIG. 1
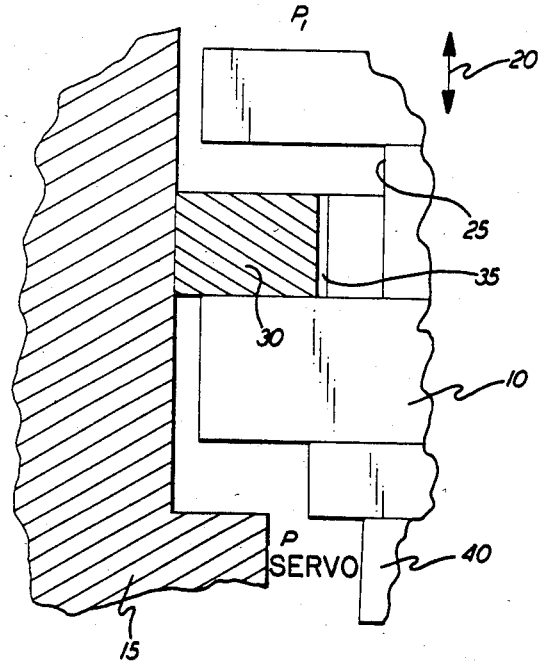
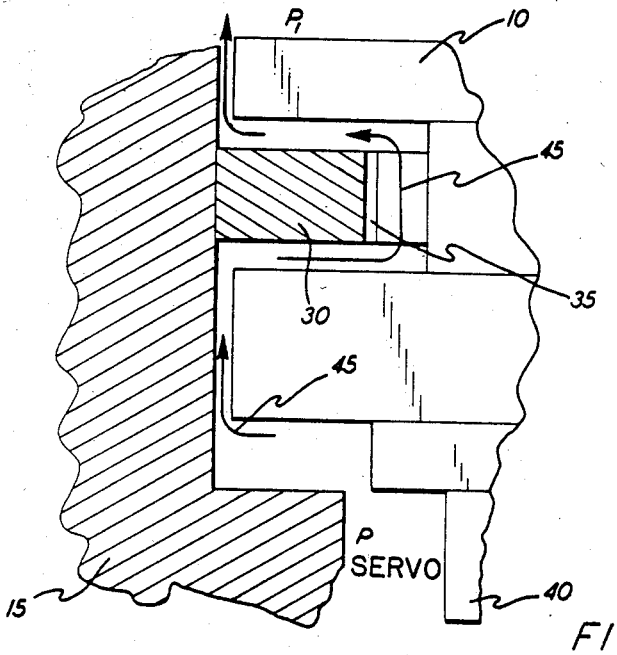
FIG. 2

FLUID ACTUATOR SLEW RATE CONTROL

TECHNICAL FIELD

This invention relates generally to fluid actuators and, more specifically, to pneumatic actuators of the piston-cylinder variety.

BACKGROUND ART

Fluid actuators and particularly pneumatic actuators are in widespread use in both commercial and industrial applications. Oftentimes, it is desirable to operate such an actuator at a predetermined rate such as, for example, when the actuator is employed to set a valve controlling high pressure bleed air from the compressor discharge section of a gas turbine engine. In such applications, actuator operation at less than desired slew rates would militate against accurate control of airflow through the actuated valve. On the other hand, slew rates greater than desired could overly stress the valve and actuator structures.

In the prior art, attempts have been made to control pneumatic actuator slew rates by controlling airflow to the actuator by means of servo fluid pressure control with a single orifice. However, it has been found that generally, a single orifice either does not allow sufficient flow for operation of the actuator at a desired speed or, provides excessive flow which cause the actuator to operate at slew rates higher than desired. While variable rate fluid motors are known in the art, such devices are generally not adaptable for use in actuators of the type discussed herein.

DISCLOSURE OF INVENTION

It is therefore among the objects of the present invention to provide a means for accurately controlling the slew rate of a fluid actuator.

In accordance with the present invention, the slew rate of a piston-cylinder type fluid actuator is controlled by initiating operation of the actuator with fluid at a first, relatively higher pressure and then, once movement of the piston is initiated, decreasing the pressure of fluid to the actuator to accurately control the sustained slew rate of the piston within the cylinder. It has been determined that slew rates cannot be accurately controlled with a single input pressure or inlet flow area (as determined by a single orifice) since a pressure higher than that required to sustain a desired slew rate is necessary to initiate movement of the piston within the cylinder. In the preferred embodiment, input pressure for sustained piston movement is lowered from the input pressure required to initiate movement of the piston by effectively lowering the flow area of the inlet to the actuator. The flow area is reduced by plugging the inlet to the actuator with a stopper having a small control orifice therethrough upon initiation of movement of the actuator piston. The orifice is sized to allow flow therethrough at pressure sufficient to operate the actuator at the required slew rate.

BRIEF DESCRIPTION OF DRAWINGS

FIG. 1 is an enlarged fragmentary elevation of a piston, piston ring and cylinder employed in a typical pneumatic actuator;

FIG. 2 is a view similar to FIG. 1, but illustrating the ring in another orientation with respect to the piston;

BEST MODE FOR CARRYING OUT THE INVENTION AND INDUSTRIAL APPLICABILITY THEREOF

Figure 3:
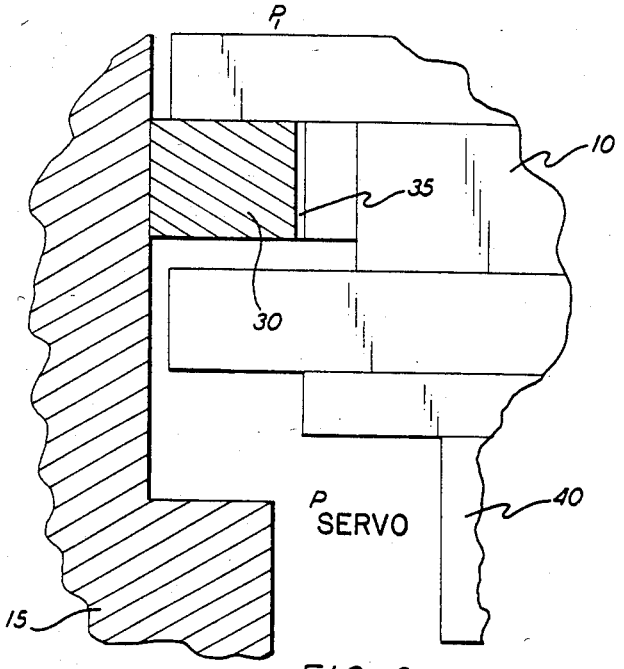
FIG. 3 is a view similar to that of FIG. 1, but showing the ring in yet another orientation with respect to the piston.

Referring to FIG. 1, the present invention is directed to a piston-cylinder type fluid actuator of any known variety wherein the piston 10 is disposed within a cylinder 15 and longitudinally movable with respect thereto in the directions indicated by arrow 20. Piston 10 is, in normal fashion, provided with a groove 25 which receives a piston ring 30 therein, ring 30 being urged radially outwardly into edgewise contact with the sidewall of cylinder 15 by an expander ring 35. The piston is mounted on piston rod 40 by any known technique and, at one end surface thereof, moves against a back pressure $P_1$, the other end surface of the piston being pressurized by a controlled servo pressure $P_{servo}$ regulated in accordance with the present invention for the control of piston movement within the cylinder.

As shown in FIG. 1, for purposes of assembly and accommodation of thermal growth ring 30 and expander ring 35 are of a lesser thickness than groove 25 whereby a clearance is defined between the upper surfaces of the piston ring and the groove.

Assuming for purposes of illustration that the actuator, as shown in FIG. 1, is in a nulled state, the piston ring occupying the lowermost portion of the groove, and it is desired to energize the actuator for upward movement of the piston, $P_{servo}$ would be increased so that the upward fluid force on the piston and ring from $P_{servo}$ overcomes the downward force thereon from back pressure $P_1$. It has been found that in pneumatic actuators, increasing $P_{servo}$ will typically raise the piston ring and expander ring within the groove before moving the piston itself. Referring to FIG. 2, this condition is illustrated. As shown in FIG. 2, when $P_{servo}$ is increased to a value sufficient to move the piston ring upwardly but not the piston itself, a leakage path from the bottom of the piston around the lateral surface thereof and through the interior of the expander ring is established, such leakage being illustrated by arrows 45. It will be appreciated then, that in order to energize piston 10 for upward movement thereof, $P_{servo}$ must be of a value sufficient to compensate for the back pressurization of the piston by pressure $P_1$ as well as the leakage through the interior of the piston ring to thereby raise the piston ring to the downstream side of the groove as shown in FIG. 3. However, such a pressure may be substantially greater than that required for sustained movement of the piston upwardly at the desired slew rate.

Figure 4:
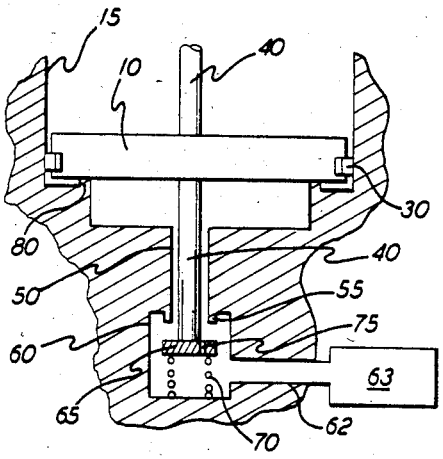
FIG. 4 is a sectional view of a pneumatic actuator utilizing the present invention, prior to movement of the actuator piston.
Figure 5:
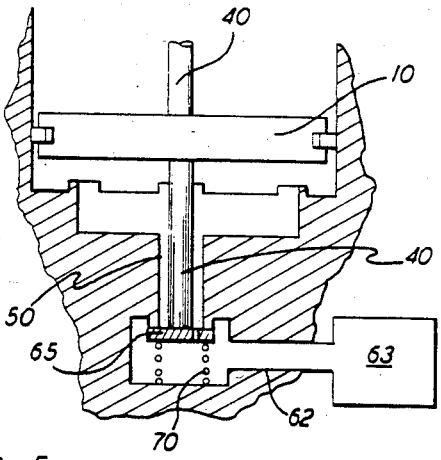
FIG. 5 is a view similar to FIG. 4, but showing a slewing of the piston.

In accordance with the present invention, the actuator is provided with means for initially applying a first high pressure to the piston and ring for moving the ring across the clearance in the groove therefor and initiating movement of the piston; means for removing the high pressure from the piston and ring upon the initiation of the piston movement and means for applying a second, relatively lower pressure to the piston and ring for sustaining actuated movement of the piston at a desired rate within the cylinder. Referring to FIG. 4, the means for applying the higher pressure to the piston comprises a fluid conduit 50 extending axially from cylinder 15 and having a raised shoulder at the lower end of the conduit which communicates with an enlarged chamber 60. This chamber in turn communicates with conduit 62 which connects the chamber to a source 63 of servo fluid. In the case of a pneumatic actuator employed in an aircraft, source 63 may comprise compressor discharge air bled from a gas turbine engine. The means for removing the higher pressure from the piston and ring comprises a stopper 65 actuated by piston rod 40 (plunger) at the lower end thereof and biased upwardly by coil spring 70 retained between the stopper and bottom wall of chamber 60. Stopper 65 is provided with a control orifice 75 extending therethrough which comprises the means for applying the lower pressure to the piston and ring. In operation, as illustrated in FIG. 4, in an unactuated state, piston 10 rests on seats 80 (bosses) extending upwardly from the bottom wall of cylinder 15. In this position, the lower end of rod 40 urges plunger 65 downwardly, thereby spacing the plunger from boss 55 and opening a large passage from the fluid pressure source 63 through duct 62, around the plunger and through conduit 50 to the underside of piston 10 and ring 30. This higher pressure will, as described hereinabove, move piston ring 30 upwardly within groove 25 to the downstream side of the groove and initiate movement of the piston. Once piston movement is initiated, as shown in FIG. 5, slight upward movement of rod 40 allows the spring to seat plunger 75 on boss 55 whereupon the only passage from fluid pressure source 63 to piston 10 is through control orifice 75. This substantially reduces $P_{servo}$ to a value corresponding to a desired rate of sustained piston movement.

Therefore, it is seen that by the present invention, the actuator is provided with an initial servo pressure adequate to move the piston ring across the groove therefor, the servo pressure being automatically reduced once piston movement is initiated for accurate slew rate control with minimal expenditure of fluid pressure.

While a particular embodiment of this invention has been shown and described, it will be appreciated that the disclosure herein will suggest various equivalent forms of the present invention to those skilled in the art and it is intended by the following claims to cover such modifications as fall within the true spirit and scope of this invention.

Having thus described the invention, what is claimed is:

1. In an actuator comprising a cylinder and a piston disposed therewithin and longitudinally movable with respect thereto, said piston including a groove in the outer surface thereof, said groove accommodating a piston ring therewithin, said groove having a width of greater dimension than the thickness of said piston ring, thereby defining a longitudinal clearance therewith, the improvement characterized by means for accurately controlling a slew rate of said piston within said cylinder, said means comprising:

means for initially applying a first, relatively higher pressure to said piston and piston ring, said higher pressure being sufficient to move said ring across said clearance, thereby initiating movement of said piston;

means for discontinuing the application of said high pressure to said piston and piston ring generally simultaneously with said initiation of piston movement; and means for applying a second, relatively lower pressure to said piston ring generally simultaneously with said initiation of piston movement, said lower pressure being sufficient to sustain actuated movement of said piston at said slew rate.

2. the actuator of claim 1 characterized by said means for applying said higher pressure to said piston comprising a fluid conduit communicating at one end thereof with said piston and at an opposite end thereof with a supply of fluid at said higher pressure.

3. The actuator of claim 2 characterized by said means for discontinuing the application of said high pressure from said piston and piston ring comprising a stopper registrable with the flow area of said fluid conduit by said initiation of piston movement.

4. The actuator of claim 3 characterized by said stopper being biased toward said registration with the flow area of said first conduit and by a plunger carried by said piston and engageable with said stopper prior to said initiation of piston movement for separating said stopper from registry with the flow area of said conduit, thereby allowing said application of said higher pressure to said piston and piston ring.

5. The actuator of claim 3 characterized by said means for applying a second, relatively lower pressure to said piston comprising an orifice extending through said stopper.

* * * * *